US005772708A

United States Patent [19]

Froehlich

[11] Patent Number: 5,772,708

[45] Date of Patent: Jun. 30, 1998

[54] COAXIAL COAL WATER PASTE FEED SYSTEM FOR GASIFICATION REACTOR

[75] Inventor: Robert Edward Froehlich, New Providence, N.J.

[73] Assignee: Foster Wheeler Development Corp., Clinton, N.J.

[21] Appl. No.: 405,653

[22] Filed: Mar. 17, 1995

[51] Int. Cl.[6] ..... C10J 3/68

[52] U.S. Cl. ..... 48/76; 48/77; 48/63; 48/64; 48/86 R; 48/86 A; 48/202; 48/206; 48/DIG. 4; 431/170

[58] Field of Search ..... 48/63, 64, 76, 48/77, 86 R, 86 A, 73, 202, 206, DIG. 4; 422/145; 110/245; 431/170; 34/576, 580, 582, 583, 585, 586

[56] References Cited

U.S. PATENT DOCUMENTS

| | | | |
|---|---|---|---|
| 3,927,996 | 12/1975 | Knudsen et al. | 48/210 |
| 4,206,713 | 6/1980 | Ryason | 48/86 R |
| 4,282,010 | 8/1981 | Cherish et al. | 48/77 |
| 4,302,353 | 11/1981 | Escher et al. | 48/86 R |
| 4,391,611 | 7/1983 | Haldipur et al. | 48/206 |
| 4,493,636 | 1/1985 | Haldipur et al. | 48/77 |
| 4,502,633 | 3/1985 | Saxon | 48/86 R |
| 4,525,175 | 6/1985 | Stellaccio | 48/86 R |
| 4,664,678 | 5/1987 | Rehmat et al. | 422/145 |
| 4,857,076 | 8/1989 | Pearson et al. | 48/86 R |
| 5,006,062 | 4/1991 | Lee et al. | 410/245 |

FOREIGN PATENT DOCUMENTS

| | | | |
|---|---|---|---|
| 3442824 | 6/1985 | Germany | 48/77 |
| 0715615 | 2/1980 | U.S.S.R. | 48/206 |

*Primary Examiner*—Nina Bhat
*Attorney, Agent, or Firm*—Martin Smolowitz

[57] ABSTRACT

A system for feeding a coal-water paste material coaxially upwardly through a feed nozzle assembly into a pressurized fluidized bed reactor having a lower portion and a larger diameter upper portion. The feed nozzle assembly includes a nozzle unit for atomizing the coal paste feed material, and a concentric outer shroud tube enclosing the nozzle unit. The feed nozzle assembly is inserted upwardly through an opening in the bottom portion of the pressurized fluidized bed reactor into a coaxial orientation with the bed, so as to provide substantially complete combustion and/or carbonization of the coal paste material fed into the reactor to produce a combustible gas product. If desired, a sorbent material nay be fed into the fluidized bed together with the coal paste feed, so as to absorb sulfur from the coal and produce a clean fuel gas. During reactor operations at 130–200 psig pressure and 1,600°–1,800° F. temperature, at hot zone is advantageously formed just above the nozzle assembly exit end which produces rapid dehydration and passivation prior to combustion of the coal with minimal agglomeration to produce a fuel gas product.

12 Claims, 2 Drawing Sheets

COAXIAL COAL WATER PASTE FEED SYSTEM FOR GASIFICATION REACTOR

BACKGROUND OF INVENTION

This invention pertains to a feed system for feeding a coal-water paste feed material coaxially upwardly into a pressurized fluidized bed combustor or gasification reactor. It pertains particularly to such a feeding system for injecting the coal-water paste material through a nozzle assembly coaxially upwardly into a pressurized coal fluidized bed (PCFB) containing a hot zone for combustion gasification and/or carbonization reactions therein to produce a fuel gas product.

The conversion/combustion of coal in pressurized fluidized bed reactors for producing fuel gas or for the direct raising of steam such as for power generation is well known. In the past, the coal feed was often introduced into the pressurized fluidized bed through a lock hopper configuration, which procedure was complicated, expensive and prone to operational problems. Also, various nozzle configurations have been developed and used for feeding coal slurry into pressurized fluidized bed reactors for combustion therein. For example, U.S. Pat. No. 4,017,253 to Wielang et al discloses a fluidized bed calciner utilizing a combustion nozzle having a tubular shroud which extends beyond the end of the nozzle into the internal chamber of the reactor vessel so as to form an antechamber within the shroud at its open end for combustion of the fuel. U.S. Pat. No. 4,193,773 to Staudinger discloses a process and burner apparatus for partial combustion of pulverized coal dispersed in an inert carrier gas, with oxygen being injected into the pulverized coal stream at two longitudinally-spaced apart locations along the burner length. U.S. Pat. No. 4,457,241 and U.S. Pat. No. 4,479,442 to Itse et al disclose a venturi-type nozzle having swirl vanes at its discharged end for burning pulverized coal in a combustion zone. Also, U.S. Pat. No. 4,391,611 and U.S. Pat. No. 4,493,636 to Haldipur et al disclose a gasification system for injecting particulate coal and process fluids upwardly into a fluidized bed gasification reactor to generate a combustible product gas. However, these known burners or nozzle devices used for gasification, carbonization or combustion systems for pulverized coal do not provide the novel configuration and operational advantages of the present coal feed system invention.

SUMMARY OF INVENTION

This invention provides a feed system adapted uniquely for feeding a coal-water paste material coaxially upwardly into a pressurizable coal fluidized bed reactor (PCFB) for carbonization and/or combustion of the coal therein, so as to produce clean fuel gas products. The feeding system includes a feed nozzle assembly of improved design providing for atomization and injection of the coal water paste feed material upwardly into a lower portion the pressurized fluidized bed reactor. The nozzle assembly is inserted coaxially upwardly through an opening into the lower end of the cylindrical-shaped reactor vessel, and is fixedly mounted in a support unit attached pressure-tightly to the reactor vessel lower end. The reactor has an upwardly expanding conical portion provided at its lower end, and the nozzle assembly has an upper end which is advantageously positioned substantially even with the reactor conical portion lower end. The reactor includes an upper portion of larger diameter than the lower portion for fluidized particle disengagement at lower upward velocity therein, and has an outlet connection at the reactor upper end for gas product removal. An intermediate side drain connection is provided at the fluidized bed upper end for overflow of excess particles from the fluidized bed, so as to control the bed height, a lower drain connection is provided in the nozzle support unit at the reactor lower end for withdrawal of any large agglomerates from the fluidized bed as needed.

The feed nozzle assembly includes a nozzle unit having an elongated inner tube surrounded concentrically by a double-wall tubular cooling having two annular spaces therein. The nozzle unit includes an upper end transition piece having a conical shaped constricting orifice portion aligned with the nozzle unit central axis and attached pressure-tightly onto the upper end of the double-walled tubular cooling member. A concentric outer tubular shroud surrounds the feed nozzle unit the shroud tube and has upper end preferably located substantially even with the upper end of the transition piece of the feed nozzle unit. This coal paste feed nozzle unit and the concentric outer tubular shroud will herewith be referred to as the feed nozzle assembly.

The feed nozzle assembly is coaxially mounted in the nozzle support unit which is attached pressure-tightly onto the reactor lower portion, and is inserted partially upwardly into the coaxial opening in the reactor vessel wall at its lower end, which wall has an upward expanding conical shape and encloses a hot zone of the reactor. An annular passage is provided between the feed nozzle assembly and the nozzle support unit below the reactor lower conical shaped portion and hot zone, through which annular passage an inert purge gas is passed upwardly into the fluidized bed in the reactor.

This invention also includes method steps for utilizing the feed nozzle assembly for feeding a coal-water paste material into the pressurized fluidized bed reactor for simultaneous evaporation and carbonization and/or combustion of the coal paste feed material therein to produce fuel gas products. During reactor operations, the reactor pressure is usually maintained at 130–200 psig, and preferably at 140–180 psig pressure. Reactor temperature is usually 1600°–1800° F., and is preferably 1650°–1750° F. temperature. During such operations, the nozzle assembly elongated inner tube conveys pressurized air through the throat section of the nozzle unit constricting end piece, while the coal-water paste feed material is passed upwardly through a first annular space around the inner tube and through the constricting orifice. A cooling liquid such as water is passed through dual annular spaces provided within the double-walled nozzle unit. Also, pressurized air is passed through a second annular space between the nozzle unit and the outer shroud tube. If desired, a purge gas such as nitrogen may be passed through a third annular space provided between the shroud tube and the conical-shaped opening in the reactor lower end.

This invention advantageously provides an improved feed system for feeding a coal-water paste material, and if desired a sorbent material such as calcium carbonate or dolomite, upwardly into a pressurized coal fluidized bed (PCFB) reactor, so as to provide uniform atomization and carbonization and/or combustion of the coal therein and produce a clean fuel gas product. This feed system avoids undesired sintering and agglomerizing of mineral or ash particles and compounds contained in the coal feed.

BRIEF DESCRIPTION OF DRAWINGS

This invention will be further described with reference to the following drawings, in which.

DESCRIPTION OF INVENTION

Figure 1:
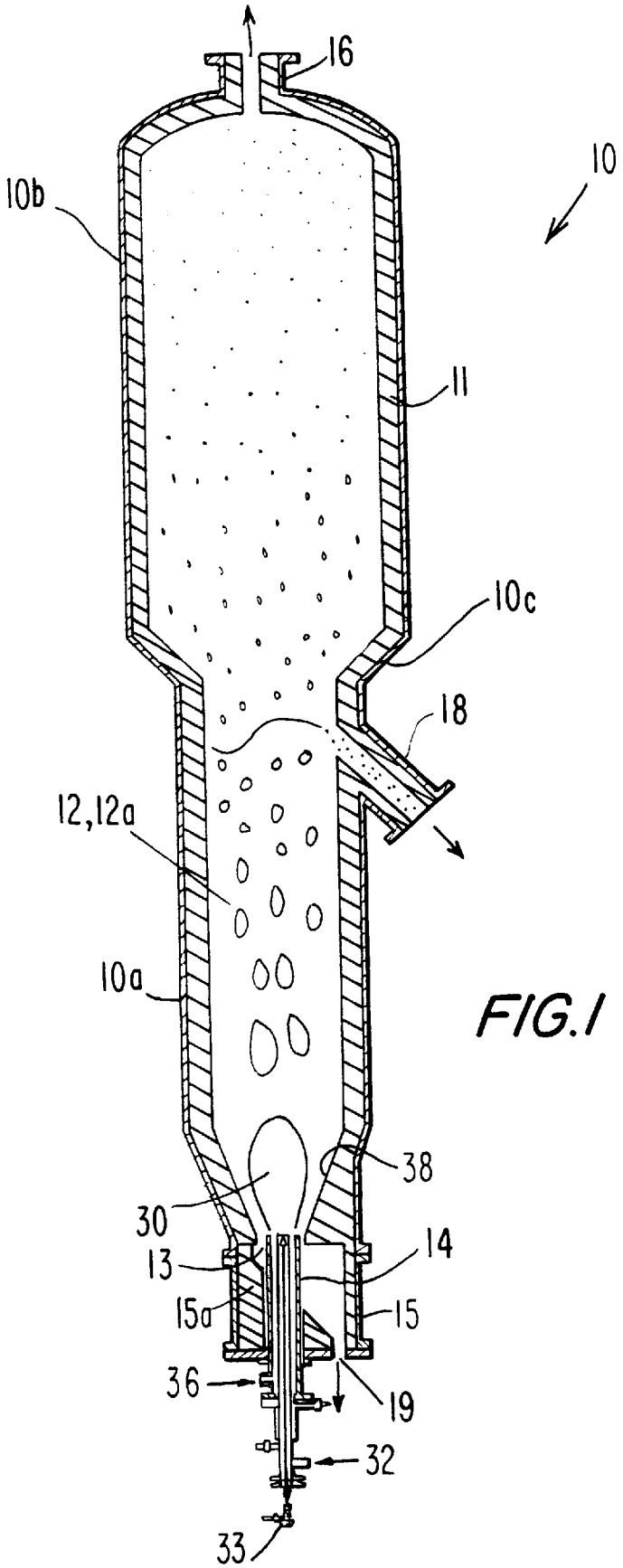
FIG. 1 is an elevation view of a pressurizable vertically-oriented fluidized bed combustor or reactor vessel having a feed nozzle assembly provided at its lower end for carbonizing a coal-water paste feed material.

As generally shown in FIG. 1, a pressurizable cylindrical-shaped vertically-oriented reactor 10 includes a lower portion 10*a* attached onto an upper larger diameter overflow portion 10*b* by an intermediate conical shaped transition portion 10*c*. The reactor 10 preferably includes an inner thermal insulation layer 11 of a suitable refractory material. The reactor 10 contains a fluidized bed 12 of particulate coal in the lower portion 10*a*. A coal-water paste feed material is reacted in the fluidized bed 12 usually in contact with a suitable particulate sorbent material 12*a* such as calcium carbonate or dolomite, so as to effectively capture sulfur compounds contained in the coal feed during its reaction with the sorbent at the reactor operating conditions. The coal and sorbent materials are introduced together with an oxygen-containing gas such as air into the reactor 10 and fluidized bed 12, 12*a* through a nozzle assembly 14 mounted coaxially in an annular opening 13 provided in the reactor lower end in a nozzle support unit 15 attached the lower end of the reactor lower portion 10*a*. The particulate coal and sorbent material are introduced through the nozzle assembly 14 from a supply conduit 32, and the oxygen-containing gas is introduced through the nozzle assembly 14 from conduit 36. Following reactions of the coal, water and sorbent in fluidized bed 12, 12*a*, the resulting pressurized product gas is removed from the reactor upper portion 10*b* through an upper outlet connection 16. The fluidized bed 12, 12*a* may expand and overflow through an intermediate side outlet 18 located near but usually below the conical shaped connecting portion 10*c* of reactor 10, so that excess ash and the sorbent material are normally withdrawn at the bed overflow drain connection 18. If required, larger particles or agglomerates can be withdrawn intermittently from fluidized bed 12 through the annular opening 13 and the nozzle support unit 15 attached pressure-tightly onto the lower end of reactor portion 10*a*, the nozzle support unit containing a bottom bed drain connection 19 provided in a refactory lining material 15*a* adjacent to the nozzle assembly 14.

For successful operations of the pressurized fluidized bed reactor 10, the coal-water paste feed mixture should contain a minimum water content of 20–30 wt.% and preferably between about 23 an 27 wt.% water. The preferred coal particle size should not exceed about 3,000 microns and is preferably 600–1,000 microns. The preferred limestone particle size should not exceed about 200 microns and is preferably 300–500 microns. The amount of sorbent addition to the coal water paste feed will be related to the sulfur content of the coal feed and the reactivity of the sorbent, so that the sorbent will usually be 5–15 wt.% of the coal. Useful reactor operating pressures are 130–200 psig, and preferably 140–180 psig, and the fluidized bed operating temperature is usually 1600°–1800° F. and is preferably 1650°1750° F.

Figure 2:
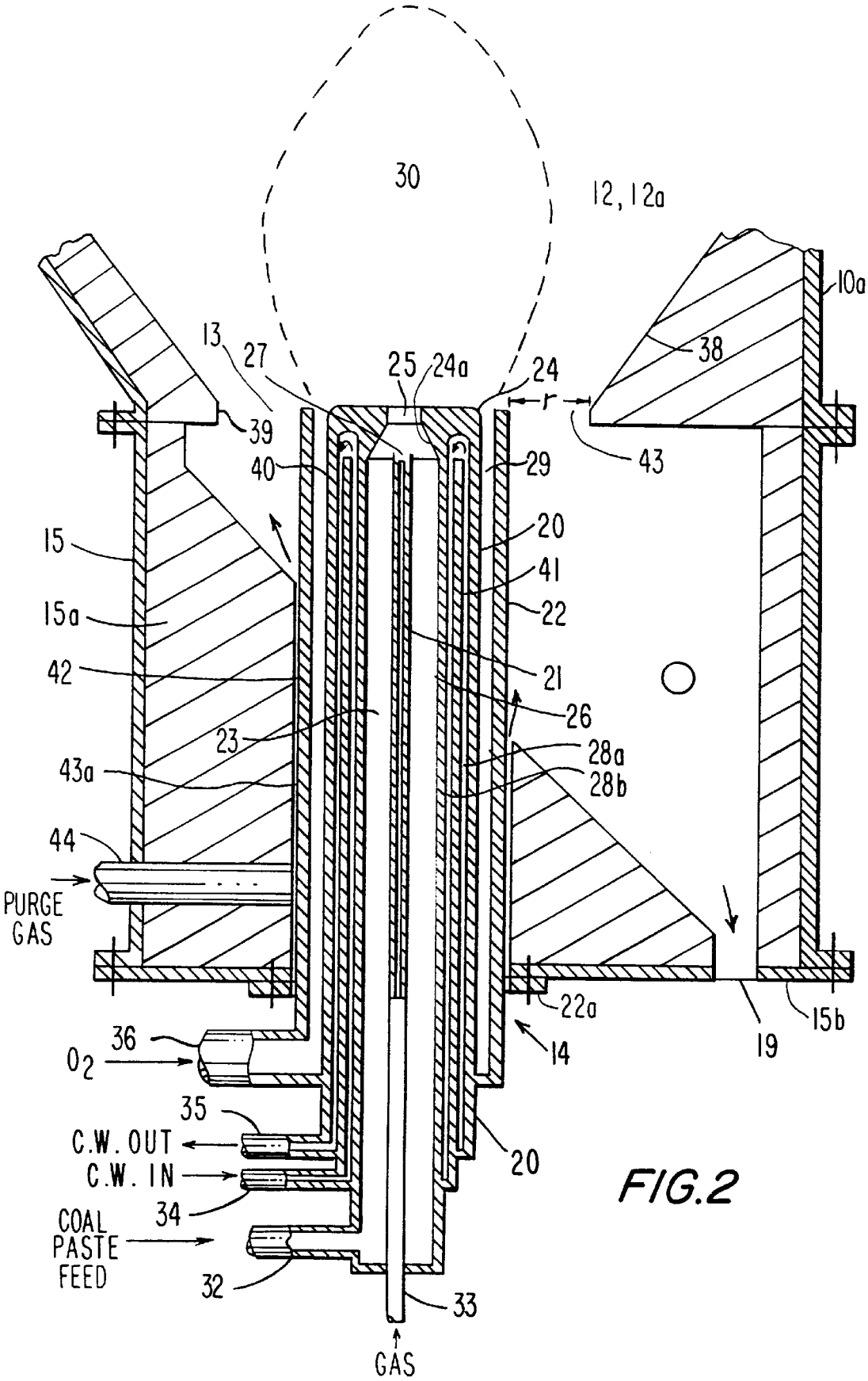
FIG. 2 shows an enlarged cross-sectional view of the reactor lower portion and the feed nozzle assembly used for feeding the coal-water paste material coaxially upwardly into the pressurizable fluidized bed reactor for carbonization and/or combustion therein according to the invention.

As shown in greater detail in FIG. 2, the coal water paste feed nozzle assembly 14 which is mounted in the support unit 15 and is inserted coaxially in the opening 13 in reactor lower portion 10*a*, includes a central feed nozzle unit 20 and a concentric tubular outer shroud element 22 having a flange 22*a* attached pressure-tightly onto the support unit lower wall 15*b*. The coal paste feed material is pressurized for its delivery into the fluidized bed 12 through the feed nozzle unit 20 from conduit 32. As seen in FIG. 2, the feed nozzle unit 20 includes an elongated inner tube 21 for conveying an atomizing gas, which may be either air or an appropriate inert gas such as pressurized nitrogen or steam, from the atomizing gas feed conduit 33. Atomization of the coalwater paste fed through the first annular passage 23 of the nozzle unit 20 occurs at the tip portion of the nozzle unit, which consists of a transition piece 24 including a central conical-shaped converging and flow constricting portion 24*a* having a 45°–75° included angle extending from an inner tube 26 to a nozzle central orifice 25 which is supplied with the atomization gas from the feed conduit 33. This transition piece 24 also encloses the terminus end 27 of the atomizing gas inner tube 21. The nozzle unit 20 is cooled by a coolant liquid such as water introduced at conduit 34 and passed through narrow annular passageways 28*a* and 28*b* provided therein, and is withdrawn through outlet conduit 35. Additional pressurized air supplied from conduit 36 is passed upwardly through a second annular space 29 between the nozzle unit 20 and the outer tubular shroud 22 into the fluidized bed 12.

During operations of the fluidized bed reactor 10, energy input from the pressurized atomizing gas supplied through the inner tube 21 in the coal paste feed nozzle unit 20 effects break up of the coal-water paste material into small droplets prior to their rapid dispersion in the fluidized bed 12 of the reactor 10 via passage through a hot zone 30 contained in a conical-shaped zone 38 in the reactor lower portion fluidized bed 12. The hot zone 30 is formed as the result of rapid consumption of oxygen contained in the oxidant stream entering the reactor feed via conduit 36 and through the second annular passage 29 with the concentric outer tubular shroud 22. A secondary source of oxygen is that contained in the coal paste feed nozzle atomization gas stream provided at conduit 33 through the inner tube 21.

Cooling of the feed nozzle transition piece 24 is effected with cooling water being introduced into nozzle unit 20 via conduit 34 and removed via conduit 35. Passage of the cooling water to and from the nozzle transition piece 24 is effected through the narrow annular spaces 28*a* and 28*b* formed by the outer wall of the inner tube 23 and the inner wall of the outer tube 40, with the flow pattern in the annular spaces being provided by an intermediate tube 41 therein.

The preferred elevation of the upper end of the transition piece 24 of the nozzle assembly 14 in the reactor lower portion 10*b* is substantially even with the upper edge of an annular collar 39 located at the bottom end of the conical-shaped zone 38. It is preferred that a radial distance "r" of at least 4 inches (10 cm) and not exceeding about 12 inches (30.5 cm) be provided for annular opening 43 located between the outer wall of the concentric tubular shroud element 22 and the face of the annular collar 39, for withdrawal of any large agglomerates from the fluidized bed 12 downwardly through the outlet connection 19 formed in the refractory lining material 15*a* of the nozzle support unit 15. A purge gas such as pressurized nitrogen may be passed upwardly through narrow annular space 42 and a third annular passage 43*a* from conduit 44 provided in the nozzle support unit 15.

The reactor fluidized bed 12, 12*a* and nozzle assembly 14 function best when the conical-shaped zone 38 has an included angle of 45°–90°, and preferably has an included angle of about 60°. The height of fluidized bed 12, 12*a* should be within a range of 10–25 feet above the top face of nozzle transition piece 24, but usually below the overflow outlet connection 18.

The existence of the hot zone 30 having temperature approximately 100° to 300° F. above the fluidized bed temperature in the reactor 10 has been substantiated by experiments performed by traversing a high temperature thermocouple through the burner hot zone in a pilot plant reactor. Introduction of atomized coal paste feed material into the hot zone 30 provides for rapid dehydration and passivation of the coal prior to its entry upwardly into the cooler area of the fluidized bed 12. Such rapid passivation of the coal feed is most critical for combusting United States eastern bituminous coals, which have a tendency to cake and form agglomerated masses of fused ash following the burn out of carbonaceous material contained in the coal. The size of hot spot 30 is primarily determined by the flow upward of oxidizing gas (air) from the second annulus space 29. The preferred gas exit velocity from annular space 29 is in the range of 30 to 60 fps.

An important feature and novelty of this coal water paste feed system is the introduction of the atomized coal paste material into the hot zone 30. Prior to this development, consideration was for feeding the coal paste into the cooler section of the fluidized bed 12, thus resulting in colder localized temperatures for the coal feed and a higher propensity for ash agglomeration and caking due to the chilling effect of evaporation of the moisture contained in the coal water paste material. In the present invention, evaporation of coal paste moisture is effected without any significant decrease in temperature due to combustion simultaneously occurring within the hot zone 30.

The feeding system configuration of this invention is particularly suitable for partial combustion/gasification of caking type coals which have a tendency to form ash agglomerates during gasification. Particle size of the coal paste feeds will usually vary between 150 and 3000 microns.

This invention will be further described by a typical example, which should not be construed as limiting in scope.

EXAMPLE

A reactor feed system and nozzle assembly adapted for feeding a coal-water paste material upwardly into a pressurized vertically-oriented fluidized bed reactor is provided. The feed system has the following dimensions and operational characteristics:

| | |
|---|---|
| Reactor lower end opening diameter, in. | 15.0 |
| Shroud tube outside dia., in. | 6.625 |
| Shroud tube inside dia., in. | 6.625 |
| Nozzle unit outside dia., in. | 4.00 |
| Inner tube outside diameter, in. | 0.476 |
| Reactor pressure, psig | 140–150 |
| Reactor temperature, °F. | 1,650 |
| Coal paste feed rate, lb/hr | 5,000–6,000 |
| Coal particle size, microns | 1,000 |
| Coal paste temperature, °F. | 70–80 |
| Air flow rate through inner tube, lb/hr | 500 |
| Cooling water flow rate, gal/min | 50 |
| Cooling water temperature, °F. | 90–100 |
| Air flow rate between nozzle and shroud tube, lb/hr | 9,000 |
| Air flow temperature, °F. | 500–600 |

By feeding the coal-water paste and sorbent materials into the fluidized bed reactor utilizing a feed nozzle assembly as described above, a hot zone is created within the fluidized bed reactor lower end in which essentially simultaneous evaporation of moisture contained in the coal paste feed material and carbonization or combustion of the coal occurs. This hot zone advantageously limits any caking of the coal feed and effectively prevents formation of agglomerates which can interfere with smooth operations of the fluidized bed gasification reactor.

It will be noted that although this invention has been described broadly and also in terms of preferred embodiments, modification and variations can be made all within the scope of the invention as defined by the following claims.

I claim:

1. A feed system for feeding a coal-water paste material into a pressurizable fluidized bed reactor of combustion/gasification reactions therein, the system comprising:

(a) a cylindrical-shaped vertically-oriented reactor vessel (10) having a lower portion **(10*a*) adapted for containing a fluidized bed (12) of particulate coal, said reactor vessel having a coaxial opening (13) provided at the lower end of the reactor lower portion (10*a*), an outlet connection (16) provided at the reactor upper end for gas removal; and a nozzle support unit (15) attached onto the reactor lower portion (10*a*) lower end, the nozzle support unit (15) having a withdrawal opening (19) provided at the support unit lower end for ash agglomerate removal; and (b) a feed nozzle assembly (14) mounted in said nozzle support unit (15) and inserted into the coaxial opening (13) provided in said reactor vessel lower portion (10*a*) so that the nozzle assembly (14) has its upper end positioned substantially adjacent and coaxial with the reactor lower end opening (13), said nozzle assembly (14) including multiple concentric tubular means adapted for introducing a coal-water paste feed material upwardly into said reactor vessel and including an elongated inner tube (21) having a terminus end (27) located upstream of a central orifice (25), for atomizing the feed material and a concentric outer tubular shroud (22), having its upper end located substantially even with the nozzle assembly (14)** upper end.

2. The feed system of claim 1, wherein said reactor vessel (10) includes a larger diameter upper portion **(10*b*) provided above and attached to said lower portion (10*a*) by an intermediate conical-shaped transition connecting portion (10*c*), and includes a side connection (18) provides in said reactor lower portion (10*a*) near said intermediate connecting portion (10*c*) for overflow particle removal from the reactor fluidized bed (12)**.

3. The feed system of claim 1, wherein said reactor lower portion **(10*a*) includes at its lower end an upwardly expanding conical section (38), and said nozzle assembly (14) is mounted pressure-tightly onto a lower wall (15*b*) of said support unit (15), the nozzle assembly (14) having its upper end located substantially even with the conical section (38)** lower end.

4. The feed system of claim 3, wherein a purge gas supply means (44) is provided in said nozzle support unit (15) for flowing a purge gas upwardly through an outer annular passage **(43*a*) around said nozzle assembly (14) and into said fluidized bed (12)**.

5. The feed system of claim 4, wherein said annular opening (43) has a radial distance of 4–10 inches.

6. The feed system of claim 3, wherein said reactor upwardly expanding conical-shaped section (38) has an included angle of 45°–90°.

7. The feed system of claim 3, wherein said nozzle unit (15) has the withdrawal opening (19) formed therein by a shaped refractory insulation material **(15*a*)**.

8. The feed system of claim 1, wherein said feed nozzle assembly (14) includes a central nozzle unit (20) having a first annular passage (23) surrounding said elongated inner tube (21) and including a transition piece (24) attached pressure-tightly to the nozzle unit (20) upper end and having the central orifice (25), and including dual cooling passageway (28*a*, 28*b*) surrounding said first annular passage (23) for coolant liquid flow therein.

9. The feed system of claim 8, wherein said transition piece (24) includes a central conical-shaped converging portion (24*a*) having a 45°–75° included angle extending from an inner tube (26) of the nozzle unit (20) to the cylindrical-shaped orifice opening (25).

10. The feed system of claim 9, wherein for said nozzle unit (20) the elongated inner tube (21) for conveying an atomizing gas, has an upper terminal end located within the conical-shaped conveying portion (24*a*) of said transition piece (24).

11. The feed system of claim 1, wherein the reactor vessel (10) has an inner thermal insulation layer (11) formed of a refractory material.

12. A feed system for feeding a coal-water paste material upwardly into a pressurized fluidized bed reactor for combustion/gasification reactions therein, said system comprising:

(a) a cylindrical-shaped vertically-oriented reactor vessel (10) having a lower portion (10*a*) adapted for containing fluidized bed (12) of particulate coal and a sorbent material, said reactor vessel having a coaxial opening (13) provided at the lower end of the reactor lower portion (10*a*), said reactor vessel having an upper portion (10*b*) of larger diameter attached to the lower portion (10*a*) by an intermediate conical-shaped transition portion (10*c*) and having an outlet connection (16) provided in the reactor upper end for gas removal; and a nozzle support unit (15) attached onto the lower end of the reactor lower portion (10*a*), the nozzle support unit (15) having a withdrawal opening (19) provided at its lower end for ash agglomerate removal; and (b) a feed nozzle assembly (14) mounted in said nozzle support unit (15) and inserted into the lower coaxial opening (13) provided in said reactor vessel lower portion (10*a*) so that the nozzle assembly (14) has its upper end positioned substantially adjacent and coaxial with the reactor lower end opening (13), said nozzle assembly (14) including a nozzle unit (20) having a central elongated inner tube (21) and a transition piece (24) with a central orifice opening (25) attached to the nozzle unit (20) at its upper end, said nozzle unit (20) having dual cooling passageways (28*a*, 28*b*) surrounding a first annual passageway (23) of the nozzle unit (20) and including a concentric outer tubular shroud (22), surrounding said dual cooling passageways (28*a*, 28*b*) nozzle unit (20), said shroud (22) having its upper end located substantially even with the nozzle assembly upper end.

* * * * *